United States Patent [19]

Swenson

[11] 4,084,065

[45] Apr. 11, 1978

[54] ANTISTRUMMING CABLE

[75] Inventor: Richard C. Swenson, North Stonington, Conn.

[73] Assignee: The United States of America as represented by the Secretary of the Navy, Washington, D.C.

[21] Appl. No.: 746,773

[22] Filed: Dec. 2, 1976

[51] Int. Cl.[2] ..... H01B 7/04; F15D 1/12; D04C 1/12

[52] U.S. Cl. ..... 174/70 R; 87/6; 87/7; 87/8; 114/243; 174/42; 174/113 R; 174/124 R; 174/131 A; 428/91

[58] Field of Search ..... 174/42, 124 R, 131 A, 174/70 R, 70 A, 113 R; 57/144; 87/1, 6, 7, 8, 9, 11, 13; 114/243; 188/1 B; 156/148; 428/91

[56] References Cited

U.S. PATENT DOCUMENTS

| | | | |
|---|---|---|---|
| 2,187,391 | 1/1940 | Borgeson | 174/121 R X |
| 3,074,144 | 1/1963 | Reed | 428/91 |
| 3,368,514 | 2/1968 | Kelly | 114/243 |
| 3,440,991 | 4/1969 | Cubbage | 114/243 |
| 3,805,667 | 4/1974 | Orser | 174/124 R X |
| 3,975,980 | 8/1976 | Hood | 87/6 |
| 3,999,003 | 12/1976 | Chevrolet et al. | 174/111 X |
| 4,010,619 | 3/1977 | Hightower et al. | 174/115 X |

*Primary Examiner*—Laramie E. Askin
*Attorney, Agent, or Firm*—Richard S. Sciascia; Arthur A. McGill; Prithvi C. Lall

[57] ABSTRACT

A yarn or fiber is incorporated into the jacket of a long suspended small diameter cable for reducing low velocity current cable strumming in water. The yarn or fiber comprises at least one-quarter of the strands of a braided cable. A nap or mossy cable effect is produced when the jacket is brushed.

2 Claims, 4 Drawing Figures

ANTISTRUMMING CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to underwater suspended cables and more particularly to the suppression of cable strumming in these underwater suspended cables in low water current velocity applications.

Prior to the present invention no practical low cost solution existed for the reduction of cable strumming in long small diameter suspended cables at low current velocities. For larger diameter cables, polyurethane ribbons and fiber fringe type fairings are currently used for low velocity applications. For high tow speeds, the larger diameter cables have used a rigid vane type fairing. The fairings for these large diameter cables are expensive and the fairings used for low velocity applications do not reduce the cable's drag. The fiber fringe fairing can be used on cables as small as three-eights inch diameter and is effective in reducing strumming. However, the fiber fringe fairing considerably increases drag since it is not omni-directional and is particularly high in cost. Another drawback of the fringe fairing is that it can inhibit cable handling and packaging.

SUMMARY OF THE INVENTION

Accordingly, it is a general purpose and object of the present invention to suppress strumming on long small diameter cable in low water currents. It is a further object that this be applicable to new cable manufacture and modification of existing cable. Further objects are the reduction of drag coefficient and fish bite hazards. These and other objects of the invention and the various features and details of construction will become obvious from the specification and drawings.

The above objects are obtained by incorporating in the overall braided cable jacket yarns or fibers. This jacket is suitable for use in newly manufactured cables and can be braided over the outer jacket of existing cable. The cable produces a mossy effect on the cable which breaks up the coherence of vortex shedding of the cable. This arrangement has particular application to cables having a diameter of one-quarter inch or less.

DESCRIPTION OF THE PREFERRED EMBODIMENTS

Figure 1:
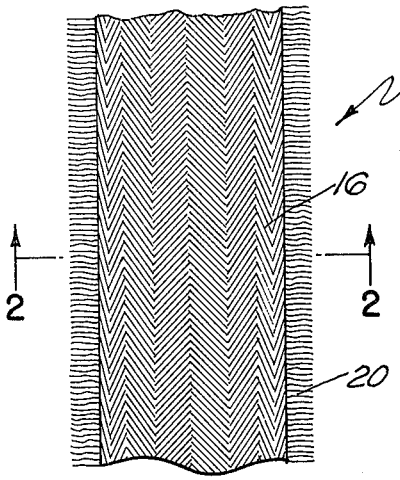
FIG. 1 is a view of a new cable in accordance with the present invention.
Figure 2:
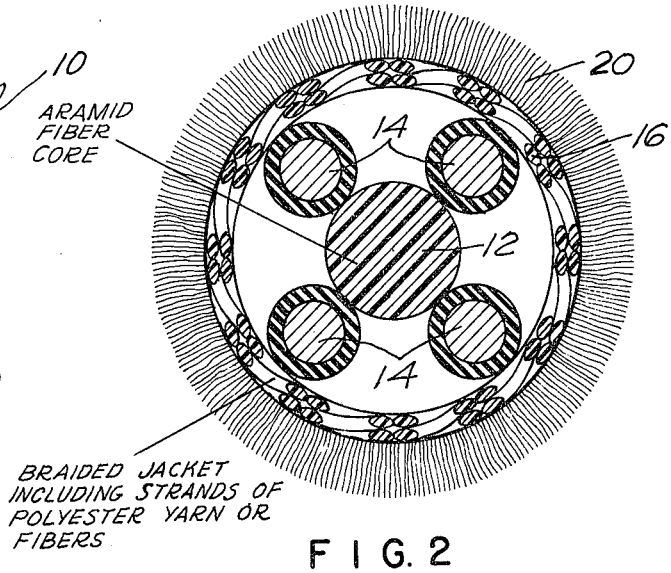
FIG. 2 is a sectional view along the line indicated 2—2 on FIG. 1.

Referring now to FIGS. 1 and 2 there is shown a cable 10 suitable for suppressing strumming when suspended underwater in low water velocity applications. The cable 10 comprises aramid fiber 12, selected for its high strength, low stretch and bending characteristics. Four electrically insulated conductors 14 are helically wound around the aramid fiber 12. A braided jacket 16 forms the enclosure of cable 10. The braided jacket 16 forms the enclosure of cable 10. The braided jacket 16 has at least 25 percent of the strands made of polyester yarn or fibers. The strands have a substantially uniform spacing at the entire outer surface of said braided jacket. The polyester yarn or fibers when brushed produce a nap or mossy cable effect 20 that reduces vortex shedding and thus strumming in low current velocities.

Figure 3:
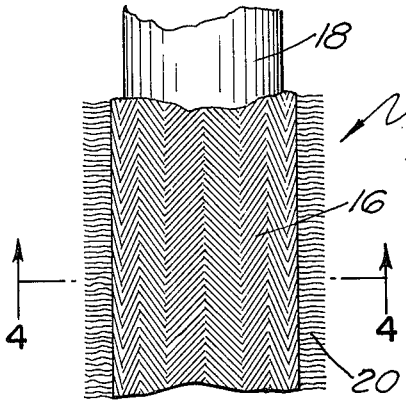
FIG. 3 is a view of a modified cable in accordance with the present invention.
Figure 4:
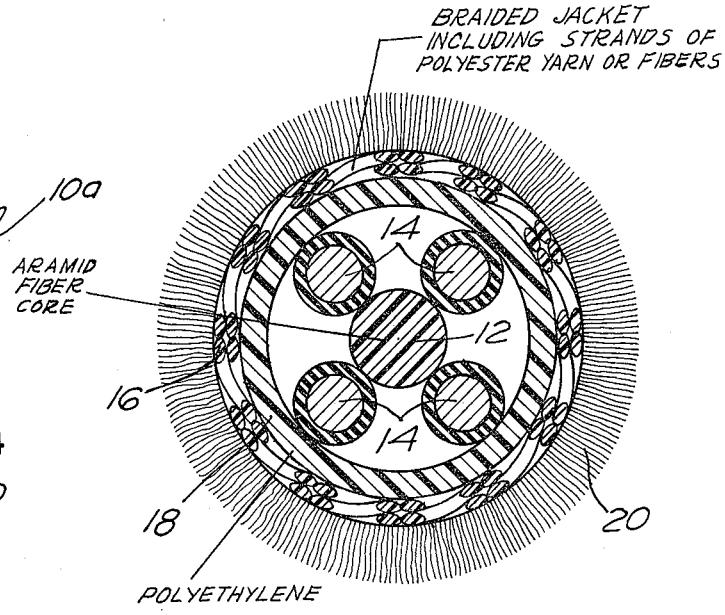
FIG. 4 is a sectional view along the line indicated 4—4 on FIG. 3.

As shown in FIGS. 3 and 4 this jacket 6 can be used on any cable **10*a* by over braiding the cable and incorporating the polyester yarn or fibers in the braid. Cable 10*a*, shown as an example, has a polyethylene covering 18**.

There has therefore been described a braided cable suitable for reducing strumming effects at low velocity in an underwater environment. It is particularly suitable for acoustic sensor array applications.

What is claimed is:

1. An antistrumming cable comprising:

conducting means for providing a path for electrical signals; and antistrumming means enclosing said conducting means and constituting the outermost surface of said cable, said antistrumming means comprising a braided jacket having at least 25 percent of the jacket made of polyester material fibers, said polyester material fibers being substantially uniformly spaced over the entire outer surface of said braided jacket said fibers having been brushed to produce a nap which provides a mossy effect that is adapted to reduce vortex shedding in seawater.

2. An antistrumming cable according to claim 1 further comprising an aramid fiber strength member enclosed by said braided jacket.

* * * * *